United States Patent [19]

Nordmark et al.

[11] 4,209,097

[45] Jun. 24, 1980

[54] SCREEN

[75] Inventors: Per-Olle Nordmark; Robert Drugge, both of Malmberget, Sweden

[73] Assignee: Luossavaara-Kiirunavaara Aktiebolag, Stockholm, Sweden

[21] Appl. No.: 946,620

[22] Filed: Sep. 28, 1978

[30] Foreign Application Priority Data

Oct. 3, 1977 [SE] Sweden ..... 7711044

[51] Int. Cl.[2] ..... B07B 1/15

[52] U.S. Cl. ..... 209/668; 209/673; 209/394

[58] Field of Search ..... 209/393-394, 209/396, 668, 673, 667, 392, 404; 198/789

[56] References Cited

U.S. PATENT DOCUMENTS

| | | | |
|---|---|---|---|
| 595,537 | 12/1897 | Foelke | 209/394 |
| 1,173,737 | 2/1916 | Quesnell | 209/668 |
| 3,770,123 | 11/1973 | Mraz | 209/668 |

FOREIGN PATENT DOCUMENTS

| | | | |
|---|---|---|---|
| 574820 | 4/1933 | Fed. Rep. of Germany . | |
| 352402 | 7/1931 | United Kingdom | 198/789 |

*Primary Examiner*—Ralph J. Hill
*Attorney, Agent, or Firm*—Fleit & Jacobson

[57] ABSTRACT

A screening apparatus has a screening surface comprising at least one group of elongate, mutually parallel and mutually adjacent screening elements, the size of the mesh defined by adjacent elements being varied by moving the elements of one and the same group transversally of their longitudinal axes while maintaining an equal distance between all said elements. Each screening element of a particular group of said elements is mounted on an associated arm arrangement which can be swung about an axis extending parallel to the long axis of an associated screening element. Planes containing the pivot axis of a respective arm arrangement and the longitudinal axis of its associated screening element are parallel to one another while the distance between said axes decreases from arm arrangement to arm arrangement in direct proportion to the distance between the pivot axes of the arm arrangements.

One advantage afforded hereby is that the force required to shift the screening elements, to change the mesh size, is smaller than with known apparatus.

3 Claims, 4 Drawing Figures

SCREEN

The present invention relates to a screen of the type whose screening surface is formed by at least one group of mutually parallel rod-like screening elements located beside each other, the screening elements in one and the same group being movable in unison transversely of their longitudinal axes, in a manner such as to vary the mesh size whilst maintaining uniform spacing between the screening elements.

Known screens of this type (see for example the German Patent No. 574 820) have the disadvantage that a large number of slide surfaces are required in order to enable the screening elements to be moved relative to one another. Because of the relatively large number of screening elements normally required in one and the same group, these slide surfaces can obtain a considerable length. Moreover, the slide surfaces rapidly become worn, even though great care is taken to protect the same from the material being screened, said wear resulting in play and poor precision. Further, as a result of the large number of slide surfaces which must be provided, which in practice results in unavoidable, large frictional forces, a large force must be applied to move the screening elements to change the size of the screen mesh.

An object of the present invention is to provide a novel and useful screen of the type mentioned in the introduction, the construction of which is such that the aforementioned disadvantages are at least substantially eliminated.

To this end there is provided in accordance with the present invention a screen of the type referred to, wherein the screening elements of one and the same group are each mounted on a respective arm arrangement which is mounted to pivot about an axis extending parallel with the longitudinal axis of the associated screening element, planes containing the pivot axis of a respective arm arrangement and the longitudinal axis of the associated screening element being parallel with each other and wherein the distance between the pivot axis of each arm arrangement and the longitudinal axis of the associated screening element decreases from arm arrangement to arm arrangement in direct proportion to the distance between the pivot axes of the arm arrangements, and wherein means are provided for pivoting the arm arrangements of one and the same group of screening elements in unison through mutually identical angles. As a result of this arrangement, only conventional, well-tried types of bearings are required; only a small force is required to change the size of the mesh; and it is ensured that the screen will operate with a high degree of precision over a relatively long period of time with a minimum of shielding of the structural elements of the screen.

A particularly simple and advantageous arrangement for varying the mesh of the screen is obtained in accordance with the invention when said means for pivoting the arm arrangements of one and the same group of screening elements in unison comprise at least one setting bar or rod which is pivotally connected to said arm arrangements at locations which lie in a plane extending parallel with a plane containing the pivot axes of the arm arrangements, planes containing the pivot axis of a respective arm arrangement and the location at which said arm arrangement is connected to the setting bar being parallel with one another, and means being provided for displacing said setting bar.

Each of the rod-like screening elements may comprise, in a manner known per se, driven rollers which are arranged to convey the oversize material across the screen. In accordance with the invention, the screening rollers are preferably driven separately, thereby enabling the rotation of speed of the rollers to be increased successively from roller to roller towards the output end of the screen, thereby to avoid rolling effects with subsequent crushing or compression of the material being screened.

The invention will now be described with reference to an embodiment thereof illustrated in the accompanying schematic drawing.

Figure 1:
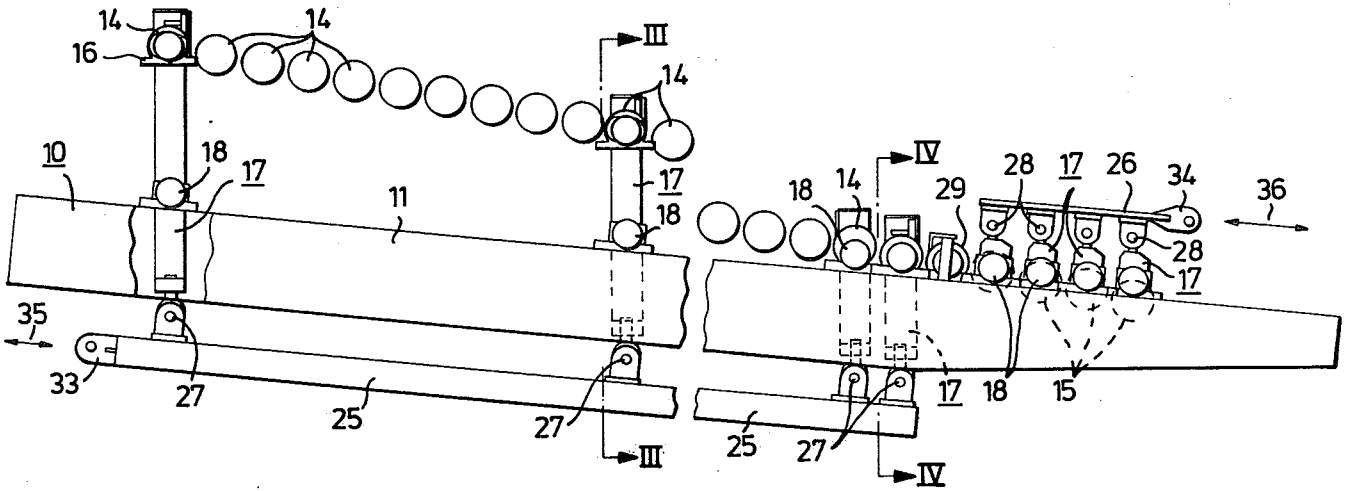
FIG. 1 is a side view of the forward and rearward part of a screen according to the invention.

The screen illustrated in the drawing comprises a frame 10 having side members 11 and forward and rearward end pieces 12 and 13 connecting said side pieces to each other. The frame 10 is supported horizontally or, as shown in FIG. 1, is arranged to slope downwardly from the forward end of the screen to its rearward end by means of legs or other support devices (not shown).

The screen is provided with a forward and a rearward group of mutually parallel rod-like screening elements, which form the screening surface of the screen, the screening elements in the forward group being referenced 14 while the screening elements in the rearward group being referenced 15. The screening elements 14 are identical to one another and are uniformly spaced apart. Similarly, the screening elements 15 are identical to one another and uniformly spaced apart, the distance, or mesh width, between adjacent elements 14 being smaller than the distance, or mesh width, between adjacent elements 15, in a manner such that the meshes of the forward group will only permit to pass therethrough a relatively fine fraction, while the meshes of the rearward group will allow to pass therethrough a relatively coarse fraction of the material being screened by means of said screen. Material of a particle size which is too coarse to pass through the meshes of the rearward group of screening elements departs between the rearmost screening element 15 and the rear end piece 13. Receptacles (not shown) can be arranged beneath the screen to receive the different fractions.

Figure 2:
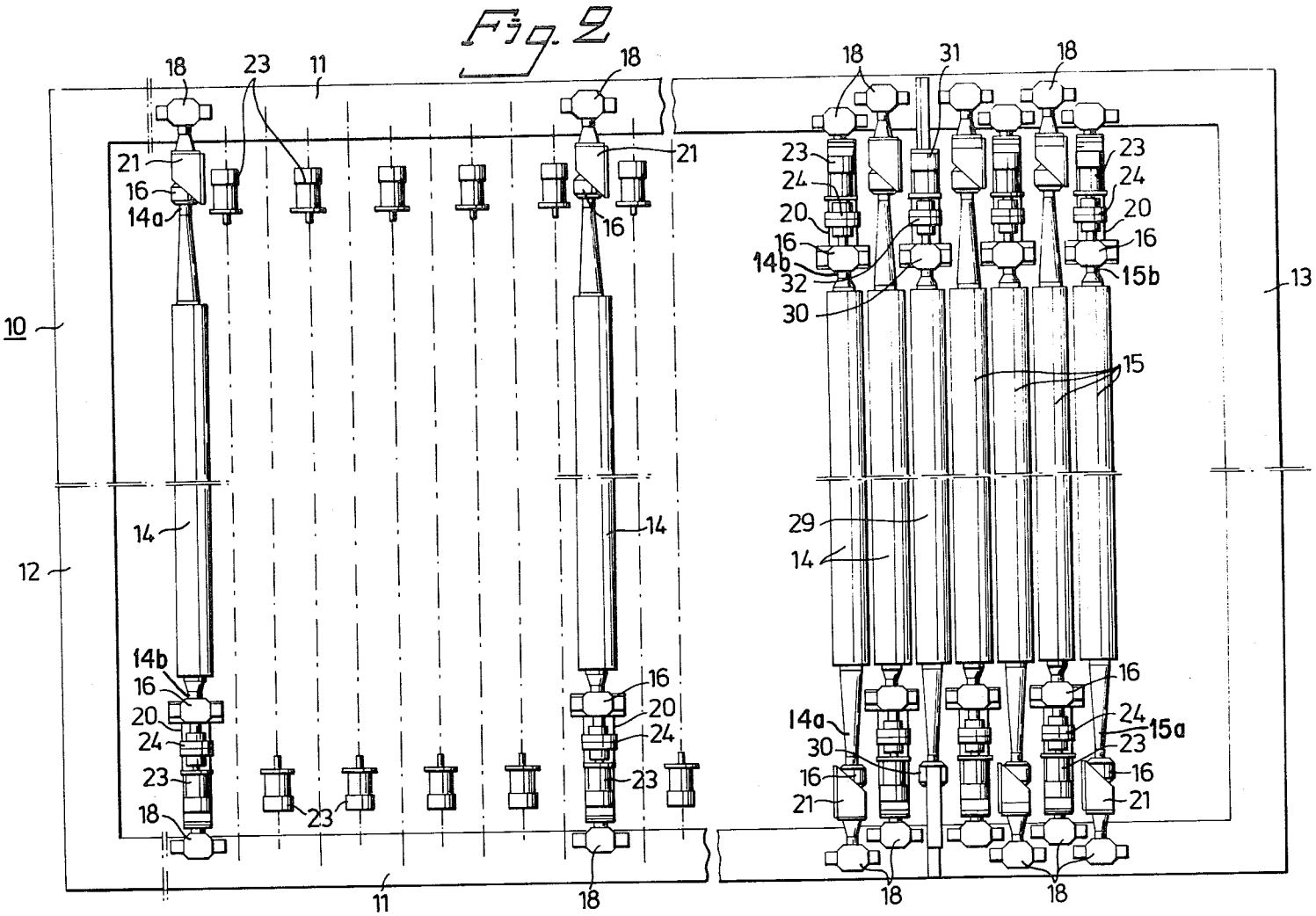
FIG. 2 is a plan view of the side parts of the screen shown in FIG. 1.

Each of the screening elements 14, 15 has a form of a roller having a long and a short trunnion **14*a*, 14*b*, 15*a* and 15*b*, said trunnions being mounted in bearings 16, the longer of said trunnions of adjacent rollers being arranged to extend in opposite directions, as shown in FIG. 2. Each screening element is carried, through associated bearings 16, by an arm arrangement 17 which, with the aid of bearings 18 carried by the frame 10, is mounted to pivot about an axis 18*a* which extends parallel to the longitudinal axis 14*c*** of the associated screening element.

Each arm arrangement 17 includes arms 19 which carry bracket means 20, 21 for the bearings 16 of associated screening elements 14 or 15, said arms 19 being mutually joined together by means of a crossmember 22. The bracket means 20 which carries the bearing 16 for the shorter of the trunnions of the screening elements 14 or 15 also carries a motor 23, such as a hydraulic motor, which is arranged to rotate the screening element at a desired, preferably variable speed through a coupling 24.

Figure 3:
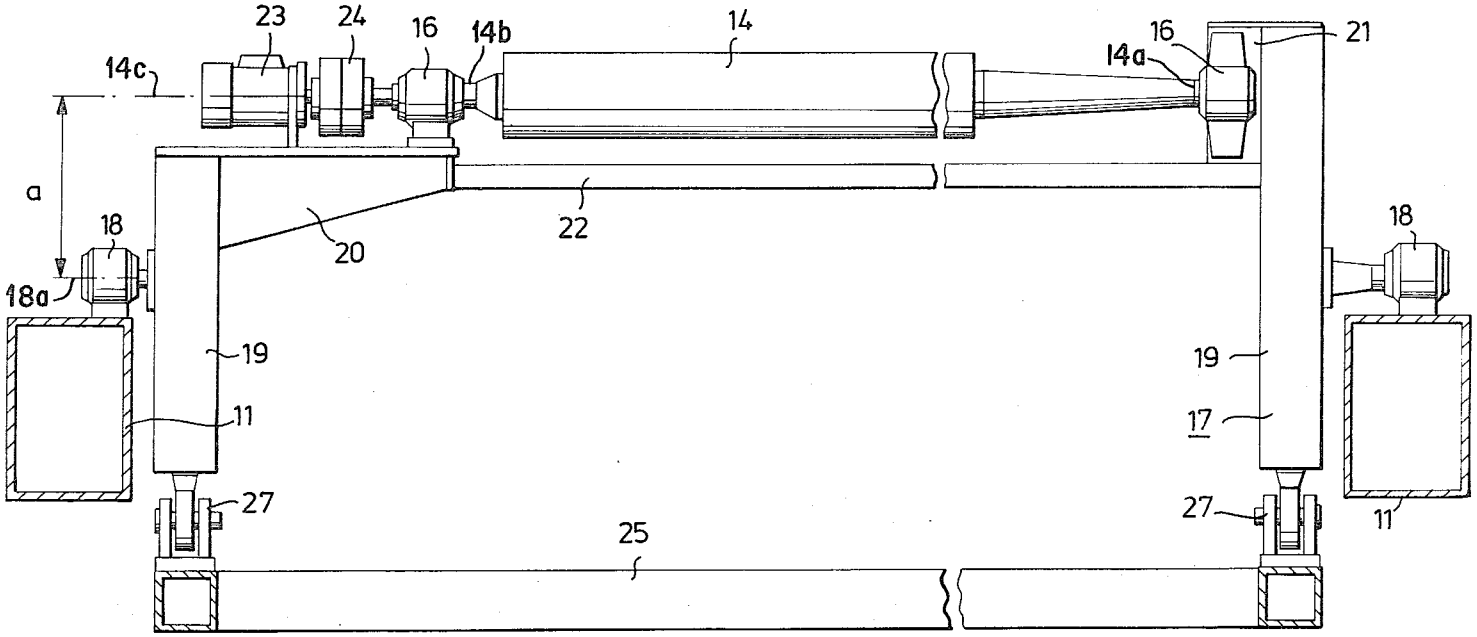
FIGS. 3 and 4 are sectional views taken on the line III—III and IV—IV respectively in FIG. 1, parts of the screening elements being omitted.
Figure 4:
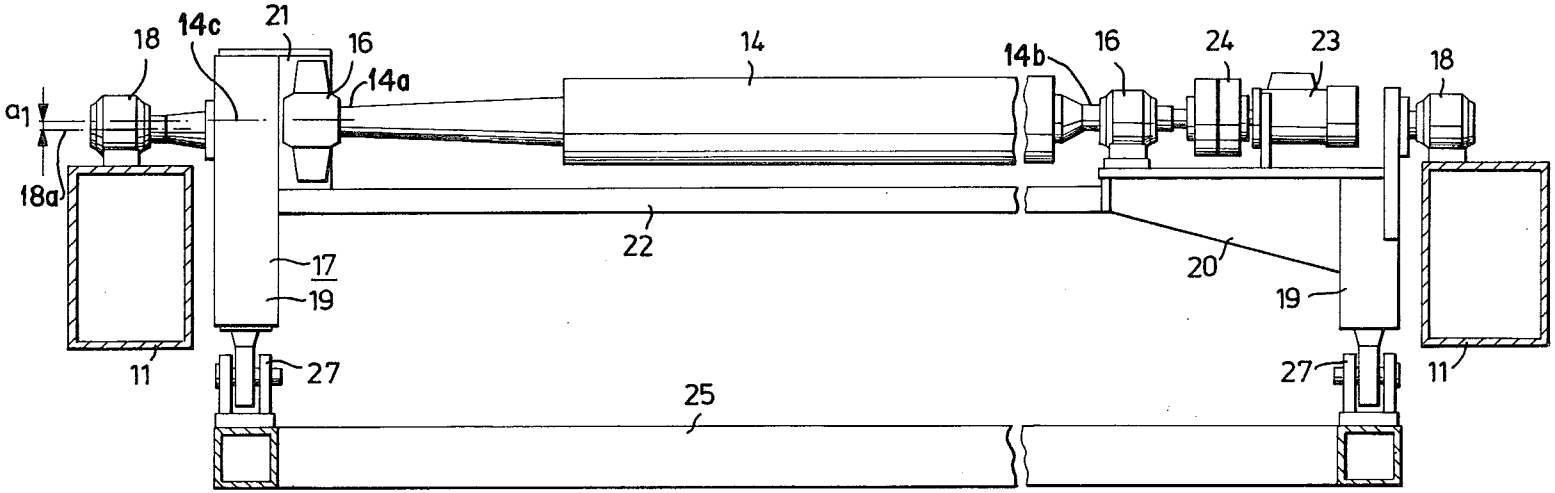

The arrangement of the arm arrangements 17 is such that planes passing through the pivot axis of a respective arm arrangement and the longitudinal axis of an associated screening element 14 or 15 are parallel with one another. Further, the distance a, $a_1$ (FIGS. 3 and 4) between the pivot axis of each arm arrangement and the longitudinal axis of an associated screening element 14 or 15 decreases from arm arrangement to arm arrangement in direct proportion to the distance between the pivot axes of the arm arrangements.

When the arm arrangements of one and the same group of screening elements are swung in unison through the same angle, the size of the mesh between the screening elements 14 or 15 will vary whilst maintaining the equispacing between the screening elements. Thus, when all the arm arrangements 17 of the screening element 14 are swung clockwise in unison, as seen in FIG. 1, the size of the mesh defined between all elements 14 will decrease to the same extent, whilst rotation of the arm arrangements in unison in a counterclockwise direction will result in a corresponding increase in mesh size.

In the illustrated embodiment, said rotation of the arm arrangements of associated screening elements of one and the same group is effected by means of frame-like setting bar means 25 and 26. These bar means are pivotally connected to all arm arrangements in the forward and rearward groups of screening elements at locations 27 and 28 respectively. The pivot points 27 are all located on a plane which extends parallel to a plane which contains the pivot axes of the arm arrangements 17 of the forward group of screening elements, planes containing the pivot axis of a respective arm arrangement 17 and the location 27, where said arm arrangement is connected to the setting bar means 25, being parallel to one another. The setting bar means 26 for the rearward group of screening elements and associated pivot points 28 and arm arrangements 17 are arranged similarly to the setting arrangement for the forward group of screening elements, although in the latter case the setting bar means 26 is located above the screening elements 15.

Arranged between the two groups of screening elements 14 and 15 is a screening element 29 in the form of a roller which is mounted for rotation in a stationary bearing 30 and is driven by a motor 31 via a coupling 32. The bearings 16 for screening elements 14 and 15 are so placed that the mesh or distance between the rearmost screening element 14 and the screening element 29 is equal to the mesh or distance between adjacent screening elements 14, and that, at the same time, the mesh or distance between the foremost screening element 15 and the screening element 29 is of the same magnitude as the mesh or distance between adjacent screening element 15.

The setting bar means 25, 26 are connected, via connecting elements 33 and 34, respectively, to setting devices (not shown) for setting the mesh size defined by the screening elements in the forward and rearward groups of screening elements to the size desired, by pivoting the arm arrangements 17 in a manner to cause movement of the setting bar means 25, 26 as indicated by the double arrows 35, 36.

The invention is not restricted to the described and illustrated embodiment, but can be modified within the scope of the following claims.

We claim:

1. A screen whose screening surface is formed by at least one group of mutally parallel rod-like screening elements located beside each other, the screening elements in one and the same group being movable in unison transversely of their longitudinal axis in a manner such as to vary the mesh size whilst maintaining uniform spacing between the screening elements, wherein the screening elements of one and the same group are each mounted on a respective arm arrangement which is mounted to pivot about an axis (18*a*) extending parallel with the longitudinal axis (14*c*) of the associated screening element, planes containing the pivot axis (18*a*) of a respective arm arrangement and the longitudinal axis (14*c*) of the associated screening element (14) being parallel to one another, and wherein the distance between the pivot axis of each arm arrangement and the longitudinal axis (14*c*) of the associated screening element decreases from arm arrangement to arm arrangement in direct proportion to the distance between the pivot axes of the arm arrangements and wherein means are provided for pivoting the arm arrangements of one and the same group of screening elements in unison through mutually identical angles.

2. A screen according to claim 1, wherein said means for pivoting the arm arrangements of one and the same group of screening elements in unison comprise at lease one setting bar (25, 26), which is pivotally connected with said arm arrangements at locations (27, 28) which lie in a plane extending parallel with a plane containing the pivot axis (18*a*) of a respective arm arrangement and the location (27, 28) at which said arm arrangement is connected to the setting bar being parallel with one another, and wherein means are provided for displacing said setting bar.

3. A screen according to claim 1 or 2, wherein the rod-like screening elements comprise separately driven rollers.

* * * * *